United States Patent [19]

Roper, Jr.

[11] 4,439,071

[45] Mar. 27, 1984

[54] PILING ENCASEMENT SYSTEM

[75] Inventor: Linwood W. Roper, Jr., Hartsville, S.C.

[73] Assignee: Sonoco Products Company, Hartsville, S.C.

[21] Appl. No.: 340,002

[22] Filed: Jan. 15, 1982

[51] Int. Cl.[3] ..... E02D 5/60

[52] U.S. Cl. ..... 405/216; 405/257

[58] Field of Search ..... 405/216, 257; 249/10, 249/49

[56] References Cited

U.S. PATENT DOCUMENTS

| | | |
|---|---|---|
| 1,039,498 | 9/1912 | Deslauriers . |
| 1,300,393 | 4/1919 | Hodges . |
| 1,443,459 | 1/1923 | Carty . |
| 1,653,706 | 12/1927 | Holland . |
| 1,670,339 | 5/1928 | Butterworth . |
| 2,668,344 | 2/1954 | Killian et al. . |
| 2,677,165 | 5/1954 | Copenhaver et al. . |
| 2,735,154 | 2/1956 | Killian et al. . |
| 2,836,874 | 6/1958 | Clarkson . |
| 2,874,548 | 2/1959 | Drushel et al. . |
| 2,928,411 | 3/1960 | Johnson . |
| 3,139,731 | 7/1964 | Liddell . |
| 3,177,667 | 4/1965 | Liddell . |
| 3,321,924 | 5/1967 | Liddell . |
| 3,505,825 | 4/1970 | Colby . |
| 3,751,196 | 8/1973 | Cannon et al. . |
| 3,934,422 | 1/1976 | Fredrickson et al. . |
| 3,956,437 | 5/1976 | Ellis . |
| 4,023,374 | 5/1977 | Colbert et al. . |
| 4,068,483 | 1/1978 | Papworth . |
| 4,116,013 | 9/1978 | Hellmers . |

*Primary Examiner*—David H. Corbin

*Attorney, Agent, or Firm*—Dennison, Meserole, Pollack & Scheiner

[57] ABSTRACT

A system of forming an in situ sleeve of concrete about a pile to provide protective reinforcement for the pile. The system utilizes spirally wound paper molding tubes to define the structural components of the concrete receiving casing or mold, with the mold consisting of a pair of cooperating arcuate tube sections formed from the molding tubes through removal of predetermined width full length portions thereof. The portion removed from the first tube is of a width less than one half of the circumference of the tube and forms a section with an opening of a width normally only sufficient to receive the pile therethrough. The removed portion of the second tube is substantially greater and provides a retained section greater than the defined opening in the first formed section to lie thereover.

7 Claims, 7 Drawing Figures

PILING ENCASEMENT SYSTEM

BACKGROUND OF THE INVENTION

Pilings, particularly those in marine environments, are subjected to deterioration from a variety of causes including marine life, constant exposure to water, pollution, and the like. While this deterioration is most noticable in wood piles, it is equally a problem, over extended periods of time, in piling of other material, including concrete, steel, etc.

This deterioration of marine piling is well known and has resulted in substantial efforts directed toward their repair, normally executed under extremely adverse conditions. As an example, it has been proposed that the piling be enclosed within a sheet or flexible barrier, note the following three patents issued to O. E. Liddell:

U.S. Pat. No. 3,139,731, July 7, 1964;

U.S. Pat. No. 3,177,667, Apr. 13, 1965;

U.S. Pat. No. 3,321,924, may 30, 1967.

Another manner of protecting marine piling, more closely associated with the present invention, is the formation about a pile of a concrete sleeve or sheath formed within a casing or mold assembled about the pile in situ. Note, as an example, the following:

U.S. Pat. No. 4,023,374, Colbert et al, May 17, 1977;

U.S. Pat. No. 4,068,483, Papworth, Jan. 17, 1978;

U.S. Pat. No. 4,116,013, Hellmers, Sept. 26, 1978.

The casings or molds used in such procedures have normally been relatively elaborate structures of plastic or metal, particularly formed to enclose and lock about a pile through the use of specifically defined hardward.

SUMMARY OF THE INVENTION

The present invention is concerned with the in situ formation of a pile reinforcing sleeve or jacket of concrete or like material. The sheath is formed utilizing a casing or mold formed from conventional column-forming mold tubes of spiral-wound paper-board construction. Examples of appropriate tubes will be noted in the following patents:

U.S. Pat. No. 2,677,165, Copenhaver et al, May 4, 1954;

U.S. Pat. No. 2,836,874, Clarkson, June 3, 1958;

U.S. Pat. No. 3,751,096, Cannon et al, Aug. 7, 1973.

For use in the manner proposed in the present invention, the tubes are utilized in pairs. The first tube has a longitudinal section thereof, less than one half the circumference of the tube and defining a chord approximately equal to or slightly greater than the diameter of the pile to be enclosed, removed. The retained portion of the tube can then be laterally introduced about the pile on which the jacket is to be formed. Incidentally, it will be appreciated that the diameter of the tube utilized is to be greater than that of the pile by an amount corresponding to the thickness of the concrete jacket or sleeve to be formed about the pile.

The second tube has a longitudinal portion similarly severed therefrom with this removed longitudinal portion leaving an arcuate tube section which defines a chordal width greater than that of the opening defined in the first tube for selective positioning thereover to complete the enclosure of the pile. It is preferred that the length of the retained section of the second tube be less than 180° for direct engagement over the first tube opening with minimal flexure being required. By the same token, it is contemplated that the opposed edges of the second tube section overlap the opposed edges of the first tube section a sufficient distance to allow some degree of arcuate shifting or sliding of the tube sections relative to each other during the installation thereof, normally occurring under rather adverse conditions.

Once positioned, this being achieved without any difficult alignment or mating problems as required with apparatus incorporating specific mounting hardware, the tube sections are banded or strapped together by any conventional means. The stability of the banded sections is assured by overlapping both edges of the second section over the outer surface of the first section. The assembled form can then be properly aligned about the pile, as by the use of wooden wedges, after which poured concrete is introduced to define, when cured, the protective reinforcing jacket or sleeve.

The paper tube mold, formed of biogradable material, can be removed and easily disposed of or, alternatively, left in place until disintegration.

The use of paper tubes as the principal structural components of the mold has several distinct advantages including ready availability due to the extremely wide spread use of the basic forming tube, and the corresponding inexpensive nature thereof, particularly when compared with the more commonly used sleeve forming molds of metal, fiberglass, and the like. In addition, the tubes, and the tube sections formed therefrom in accordance with the present invention, are easily stored on the job site, readily cut to length, and conveniently handled during all stages of the use thereof, including the final stripping from the formed sheath.

Additional objects and advantages of the invention will become apparent from the following more detailed description of the construction and operation of the invention.

DESCRIPTION OF THE PREFERRED EMBODIMENT

Figure 1:
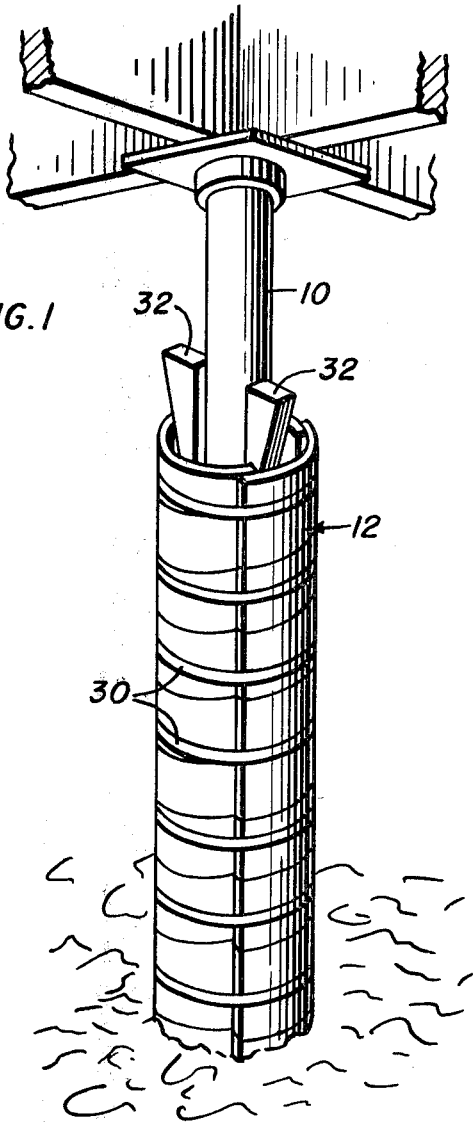
FIG. 1 is a perspective view of an assembled casing or mold in accordance with the present invention and prior to a pouring of the concrete.
Figure 2:
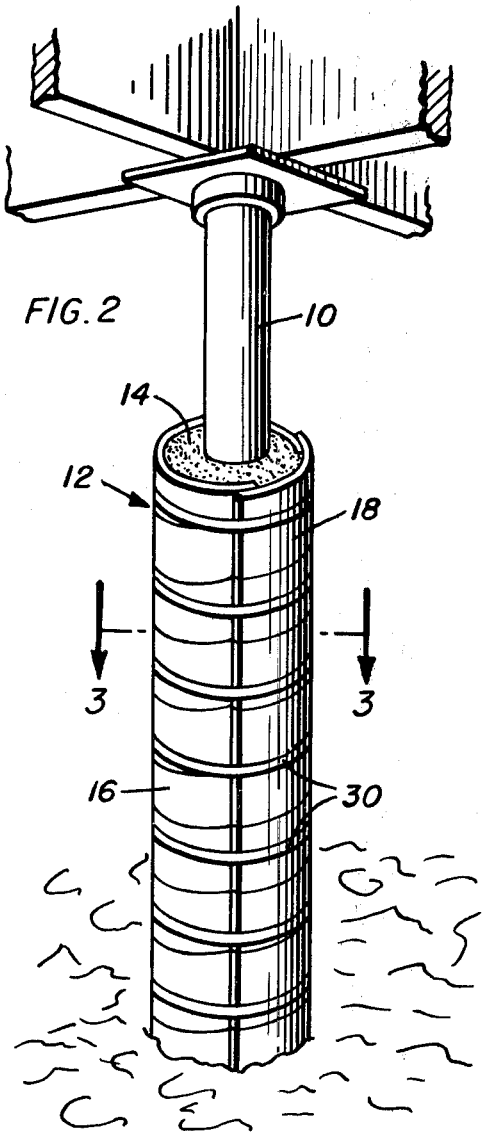
FIG. 2 is a perspective view similar to FIG. 1 illustrating the assembly subsequent to the pouring of the concrete sleeve or sheath and prior to the removal of the mold.

Referring now more specifically to the drawings, FIGS. 1 and 2 illustrate the general environment of the primary area of use of the present invention, that is marine pilings. In FIG. 1, a typical marine pile 10 has been illustrated with the casing or mold 12 of the present invention mounted thereabout and positioned for the reception of poured concrete to define a pile protecting and reinforcing concrete sleeve or sheath 14.

While such a concrete sheath will normally be formed about a pile 10 which has deteriorated or weakened over a period of time, it is also contemplated that the system of the present invention be equally adapted to the formation of a concrete sheath 14 about a new or full strength pile to define additional protective and/or reinforcement means therefor.

Figure 5:
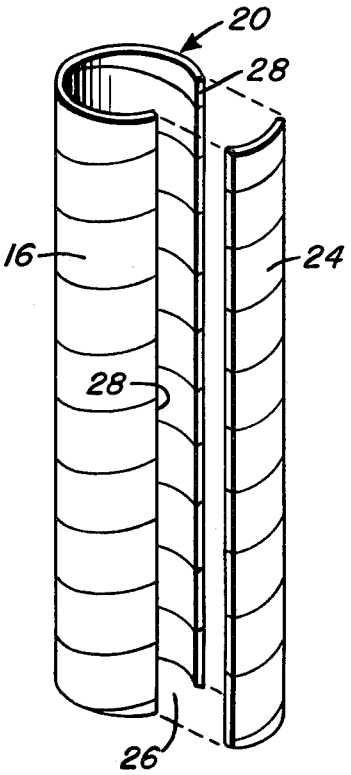
FIG. 5 is a perspective illustration of the modification of a tube to define the first pile-encircling tube section of the casing.
Figure 6:
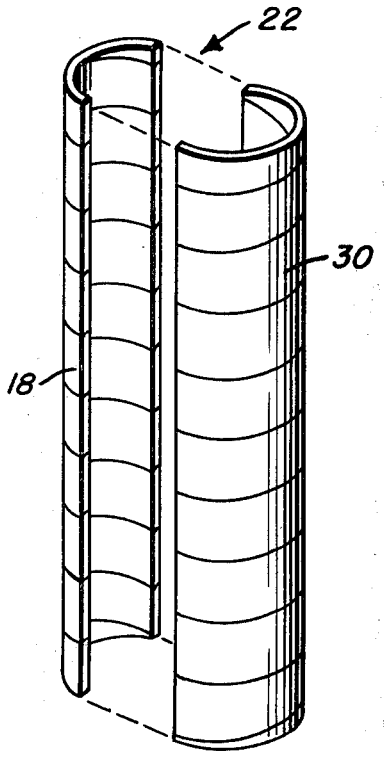
FIG. 6 is a perspective illustration of the modification of a second tube to define the second tube section of the casing or mold of the present invention.

The casing or mold consists of first and second tube sections 16 and 18 each defined, as suggested in FIGS. 5 and 6, from conventional paper or paper-board molding tubes separately herein designated, for purposes of description, as 20 and 22. As deemed appropriate, and as in fact conventionally done, these tubes may be inpregnated or coated with appropriate waterproofing or water-repellent means to ensure the structure integrity thereof during the actual molding operation.

Figure 3:
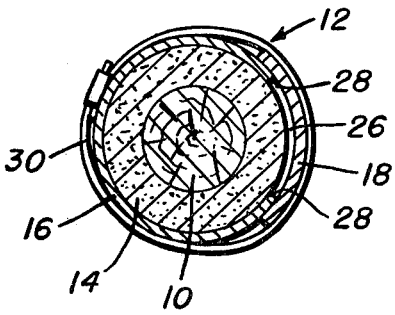
FIG. 3 is a cross-sectional detail taken substantially on a plane passing along line 3—3 in FIG. 2.
Figure 4:
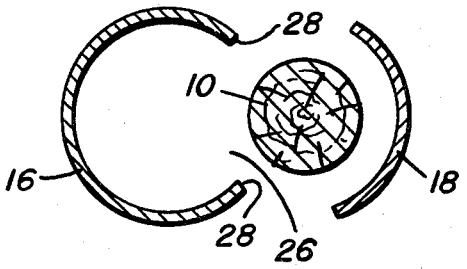
FIG. 4 is a cross-sectional detail illustrating the casing or mold sections positioned to the opposite sides of a pile immediately prior to assembly about the pile.

The major tube section 16, that is the section which is to define the major portion of the pile surrounding sheath, is formed, from the first tube 20, by the removal of a full length arcuate portion 24 therefrom. This removed portion 24 covers an arc less than one half of the circumference of the tube and provides an opening 26, defined by opposed longitudinal edges 28 on the main tube section 16, which is of a width approximately equal to and preferably slightly greater than the diameter of the pile 10 about which the section 16 is to be positioned. In this manner, and as will be best appreciated from FIGS. 3 and 4, the primary or main tube section 16 need only be laterally moved into surrounding relation to the pile 10 with little, and preferably no, flexure of the section 16.

Figure 7:
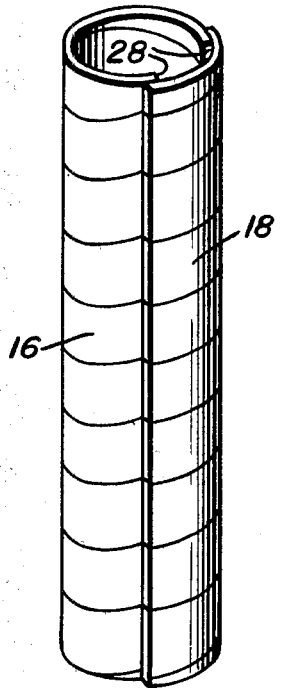
FIG. 7 is a perspective illustration of the assembly of the two tube sections to define the mold.

The casing or mold 12 is completed by the closing of the first section opening 26 with the second smaller or secondary arcuate section 18. This section 18, as will be appreciated from FIG. 6 in particular, is formed from a standard wound paper mold tube by removal of a major portion 30 of the tube whereby the retained portion, the tube section 18, is of an arcuate width sufficient to completely overlie the opening 26 and extend beyond the opposed opening edges 28 a sufficient distance to allow an appreciable degree of rotational shifting of the second section 18 relative to the primary section 16. This overlap of section 18 on section 16 will be readily appreciated from FIGS. 3 and 7, and, is considered a particularly desirable feature in that proper alignment of the sections can be easily achieved, even under the adverse conditions normally encountered in the environment of use of the invention. Further, support of both edges of the second section provides a stable assembly when banded.

As will be noted, the arcuate width of the section 18 will, under most practical applications, be no greater than one half the circumference of the tube 22, and in most instances, substantially less. As such, and as a practical and economic expedient, more than one section 18 can be defined from a single tube 22, thus allowing the formation of, as an example, two casings or molds utilizing only three tubes. Incidentally, the tubes 20 and 22 will normally be of the same size whereby the assembled sections 16 and 18 closely approximate the original tubular configuration of the individual tubes. This in turn will result in the formation of a sleeve which quite closely approaches a uniform cylinder.

As will be appreciated, the size of the concrete sleeve or sheath 14 desired will dictate the size of the tube sections 16 and 18, and the tubes 20 and 22 from which these sections are defined.

The use of paper tubes in the formation of the mold of the present invention introduces significant economies, in addition to those inherent in the inexpensive nature of the basic tube itself, as compared to the much more elaborate plastic and metal molding apparatus heretofore relied on. Primarily, the casing 12 of the present invention can be constructed directly at the job site, requiring only the use of a circular saw or other tube cutting means to sever and remove the appropriate longitudinal portions of the tubes and cut the remaining tube sections to the appropriate length. Alternatively, the tubes themselves can be cut to length prior to a defining of the tubular casing-forming sections.

After the sections are properly positioned about a pile, appropriate and conventional straps, bands, or the like 30 can be applied about the aligned sections 16 and 18 for a positive retention of the sections in tubular surrounding relation to the pile 10. The inherent rigidity of the tube sections 16 and 18, as well as the stability provided by the overlapping relationship therebetween and the defined tubular configuration, result in the provision of a rigid construction the strength of which approaches that of the original tubes.

Prior to the pouring of the concrete, and as suggested in FIG. 1, appropriate positioning wedges 32 can be utilized to concentrically locate the formed casing or mold 12 about the pile 10.

After the concrete has been poured, and appropriately cured or set to define the reinforcing sleeve 14, the bands or straps 30 can be severed or released, and the mold sections 16 and 18 removed. Alternatively, the sections 16 and 18 can merely remain in place for ultimate biodegradation.

From the foregoing, it will be appreciated that a system has been defined for the formation of a two-part casing or mold, particularly usable in the construction of a pile encircling sleeve. The mold itself is, in light of the simplicity, ease of use, and uniqueness of construction, possessed of significant structural and utilitarian advantages.

I claim:

1. For use in the formation of a reinforcing sleeve of concrete or the like about a pile, a mold for encircling a pile in outwardly spaced relation thereto, said mold comprising a first integral one-piece section of partial tubular configuration and an independent second integral one-piece section of partial tubular configuration, said first section extending about an arc of greater than 180° and having opposed longitudinal edges defining an opening of an arc of less than 180°, said second section extending about an arc greater than that of the opening for positioning over said opening, said first section including an outer surface, said second section terminating in opposed edges positioned in overlying relation to the outer surface of said first section circumferentially spaced from the opening beyond the opposed edges of the opening, the opposed edges of said second section being directly supported by said first section.

2. The mold of claim 1 wherein said second section is shiftable about the outer surface of said first section beyond both edges of the opening while maintaining a positioning over the opening.

3. The mold of claim 2 wherein said sections constitute severed sections of preformed wound paper tubes.

4. The mold of claim 2 wherein said sections are combinable about a pile to define an approximate tubular configuration in radially spaced relation about the pile.

5. The mold of claim 4 including retaining means engaged with the combined sections for a retention thereof about the pile, said retaining means consisting solely of section encircling band means.

6. A method of forming a pile-encircling two section tubular mold comprising, providing an integral elongated tube of predetermined circumference, severing, from said tube, a longitudinal portion of a circumferential width less than 180° to define a retained first tubular section of a circumferential width greater than 180°, said first section having an outer surface and opposed longitudinal edges circumferentially spaced to define an opening, providing a second elongated tubular section of a circumferential width less than 180° and greater than the circumferential width of the removed longitudinal portion of the tube to overly said opening and overlap the outer surface of said first section beyond the longitudinal edges of the first section, positioning said first section about a pile in general coaxial outwardly spaced relation thereto, positioning said second section in overlying relation to said opening and in overlying engagement with the outer surface said first section beyond the longitudinal edges of the first section to define a generally tubular configuration, and securing said sections in the defined tubular configuration by encircling said sections with retaining bands.

7. The method of claim 6 wherein said second tubular section is obtained by providing a second integral elongated tube of a circumference approximately equal to that of the first mentioned tube, and severing said second section from said second tube.

* * * * *